US008215272B2

(12) United States Patent
Takemura et al.

(10) Patent No.: US 8,215,272 B2
(45) Date of Patent: Jul. 10, 2012

(54) VARIABLE VALVE TIMING CONTROL APPARATUS FOR INTERNAL COMBUSTION ENGINE

(75) Inventors: Yuichi Takemura, Toyohashi (JP); Minoru Wada, Obu (JP)

(73) Assignee: Denso Corporation, Kariya (JP)

( * ) Notice: Subject to any disclaimer, the term of this patent is extended or adjusted under 35 U.S.C. 154(b) by 287 days.

(21) Appl. No.: 12/777,746

(22) Filed: May 11, 2010

(65) Prior Publication Data

US 2010/0288215 A1 Nov. 18, 2010

(30) Foreign Application Priority Data

May 12, 2009 (JP) ..... 2009-115500

(51) Int. Cl.
*F01L 1/34* (2006.01)

(52) U.S. Cl. ..... 123/90.15; 123/90.17; 464/160

(58) Field of Classification Search ..... 123/90.15, 123/90.17; 464/1, 2, 160
See application file for complete search history.

(56) References Cited

U.S. PATENT DOCUMENTS 5,738,056 A 4/1998 Mikame et al.
6,330,870 B1 12/2001 Inoue et al.
8,146,550 B2 * 4/2012 Takemura ..... 123/90.17
2001/0039931 A1 11/2001 Ogawa

FOREIGN PATENT DOCUMENTS

JP 2002-250239 9/2002

* cited by examiner

*Primary Examiner* — Ching Chang
(74) *Attorney, Agent, or Firm* — Nixon & Vanderhye PC

(57) ABSTRACT

In a variable valve timing control apparatus, a hydraulic variable valve timing device adjusts valve timing by changing a VCT phase. In a lock mode, the lock pin is allowed to be displaced in a lock direction for locking the VCT phase, and the VCT phase is slightly shifted in a lock-mode VCT phase shift direction corresponding to one of an advance direction and a retard direction. A lock control unit shifts the VCT phase in a direction opposite from the VCT phase shift direction if the VCT phase is located on a lock-mode VCT phase shift direction side of the intermediate lock position when the engine becomes equal to or less than a first rotational speed, and otherwise the lock control unit allows the lock pin to be displaced in the lock direction.

5 Claims, 8 Drawing Sheets

VARIABLE VALVE TIMING CONTROL APPARATUS FOR INTERNAL COMBUSTION ENGINE

CROSS REFERENCE TO RELATED APPLICATION

This application is based on and incorporates herein by reference Japanese Patent Application No. 2009-115500 filed on May 12, 2009.

BACKGROUND OF THE INVENTION

1. Field of the Invention

The present invention relates to a variable valve timing control apparatus for an internal combustion engine, which apparatus includes an intermediate lock mechanism that locks a rotational phase of a camshaft relative to a crankshaft of the engine at an intermediate lock position. The rotational phase may be referred to as a "VCT phase". and typically, the intermediate lock position is located between a full retard position and a full advance position of an adjustable range of the rotational phase.

2. Description of Related Art in a conventional hydraulic variable valve timing device, as shown in JP-A-H9-324613 and JP-A-2001-159330, a lock position during engine stop is set at a generally middle phase within an adjustable range of a VCT phase such that the adjustable range of valve timing (VCT phase) is enlarged. In the above conventional art, the above intermediate lock position, at which the phase is locked during the engine stop, is set at a phase suitable for starting the engine. The engine is started while the VCT phase is at the intermediate lock position. Also, when oil pressure have been raised to a preferable pressure due to the increase of the engine rotational speed (oil pump rotational speed) after starting the engine, the lock is released such that valve timing (VCT phase) is feed-back controlled. In the above, the VCT phase is computed based on the pulse signals that are outputted synchronously with the engine rotation from rotation angle sensors (a cam angle sensor and a crank angle sensor). Thus, actuation oil pressure of the variable valve timing device is feed-back controlled such that the VCT phase, which has been released from the lock position, becomes a target VCT phase that is set in accordance with the engine operational state.

In the variable valve timing device having the above intermediate lock mechanism, a lock control is executed when the engine rotation speed is reduced equal to or less than a predetermined rotational speed in response to an engine stop request. More specifically, in the lock control, the intermediate lock mechanism is caused to lock the VCT phase. When the engine is operated in a substantially low rotation range, such as a case immediately before the stop of the engine rotation or a case of the start of the engine (during the cranking), the output pulses of the rotation angle sensors are not sharp enough, and thereby it is difficult to identify the edges of the pulses. As a result, it may be difficult to compute the VCT phase, and thus it may not be clear whether the VCT phase is locked at the intermediate lock position. Thus, even if the VCT phase is not locked at the intermediate lock position by failure during the stop of the engine, the failure in locking the VCT phase would not be identified erroneously. As a result, for example, in a case, where the VCT phase of the intake valve is located around the full advance position at the stopping of the engine, the engine accordingly has to be restarted under the above state during the start of the engine in the next operation. Thus, abnormal combustion, such as pre-ignition, is more likely to occur disadvantageously.

SUMMARY OF THE INVENTION

The present invention is made in view of the above disadvantages. Thus, it is an objective of the present invention to address at least one of the above disadvantages.

To achieve the objective of the present invention, there is provided a variable valve timing control apparatus for an internal combustion engine having a camshaft and a crankshaft, the variable valve timing control apparatus including a hydraulic variable valve timing device, a lock pin, an oil pressure control device, a lock control unit, and a rotational speed detector. The hydraulic variable valve timing device is configured to adjust valve timing by changing a VCT phase that is a rotational phase of the camshaft relative to the crankshaft. The lock pin is configured to lock the VCT phase at an intermediate lock position located between a full retard position and a full advance position within an adjustable range of the VCT phase. The oil pressure control device is configured to control oil pressure that actuates the variable valve timing device and the lock pin. The lock control unit is configured to control the oil pressure control device to execute a lock control, in which the lock pin is displaced in a lock direction to lock the VCT phase at the intermediate lock position when a lock request is generated. The rotational speed detector is configured to detect a rotational speed of the internal combustion engine. The oil pressure control device has a hydraulic control valve that integrally includes first means and second means. The first means controls oil pressure that actuates the VCT phase. The second means controls oil pressure that actuates the lock pin. The oil pressure control device is operated under the following operational modes based on a control amount of the oil pressure control device. In a retard operation mode, the VCT phase is shifted in a retard direction. In a hold mode, the VCT phase is maintained at a certain position. In an advance operation mode, the VCT phase is shifted in an advance direction. In a lock mode, the lock pin is allowed to be displaced in the lock direction, and the VCT phase is slightly shifted in a lock-mode VCT phase shift direction that corresponds to one of the advance direction and the retard direction. The lock control unit controls the oil pressure control device to shift the VCT phase in a direction opposite from the VCT phase shift direction if the VCT phase is located on a lock-mode VCT phase shift direction side of the intermediate lock position when the rotational speed of the internal combustion engine becomes equal to or less than a first rotational speed that is lower than a target idle rotation speed during a stop of rotation of the internal combustion engine. The lock control unit controls the oil pressure control device to allow the lock pin to be displaced in the lock direction if the VCT phase is not located on the lock-mode VCT phase shift direction side of the intermediate lock position when the rotational speed of the internal combustion engine becomes equal to or less than the first rotational speed during the stop of the rotation.

To achieve the objective of the present invention, there is also provided a variable valve timing control apparatus for an internal combustion engine having a crankshaft and a camshaft, the variable valve timing control apparatus including a hydraulic variable valve timing device, a lock pin, an oil pressure control device, a lock control unit, a rotational speed detector, and a temperature detector. The hydraulic variable valve timing device is configured to adjust valve timing by changing a VCT phase that is a rotational phase of the camshaft relative to the crankshaft. The lock pin is configured to lock the VCT phase at an intermediate lock position located between a full retard position and a full advance position within an adjustable range of the VCT phase. The oil pressure control device is configured to control oil pressure that actuates the variable valve timing device and the lock pin. The lock control unit is configured to control the oil pressure control device to execute a lock control, in which the lock pin is displaced in a lock direction to lock the VCT phase at the intermediate lock position when a lock request is generated. The rotational speed detector is configured to detect a rotational speed of the internal combustion engine. The temperature detector is configured to detect one of coolant temperature, oil temperature, and intake temperature of the internal combustion engine. The lock control unit controls the oil pressure control device to shift the VCT phase toward one of the full retard position and the full advance position in a period before the rotational speed of the internal combustion engine exceeds a predetermined rotational speed during a start of the internal combustion engine if the one of the coolant temperature, the oil temperature, and the intake temperature is equal to or greater than a predetermined temperature. The lock control unit controls the oil pressure control device to allow the lock pin to be displaced in the lock direction in the period before the rotational speed of the internal combustion engine exceeds the predetermined rotational speed during the start of the internal combustion engine if the one of the coolant temperature, the oil temperature, and the intake temperature is less than the predetermined temperature. The VCT phase is computable when the rotational speed is greater than the predetermined rotational speed.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

One embodiment, which applies the present invention to a variable valve timing control apparatus for adjusting an intake valve, will be described below.

Figure 1:
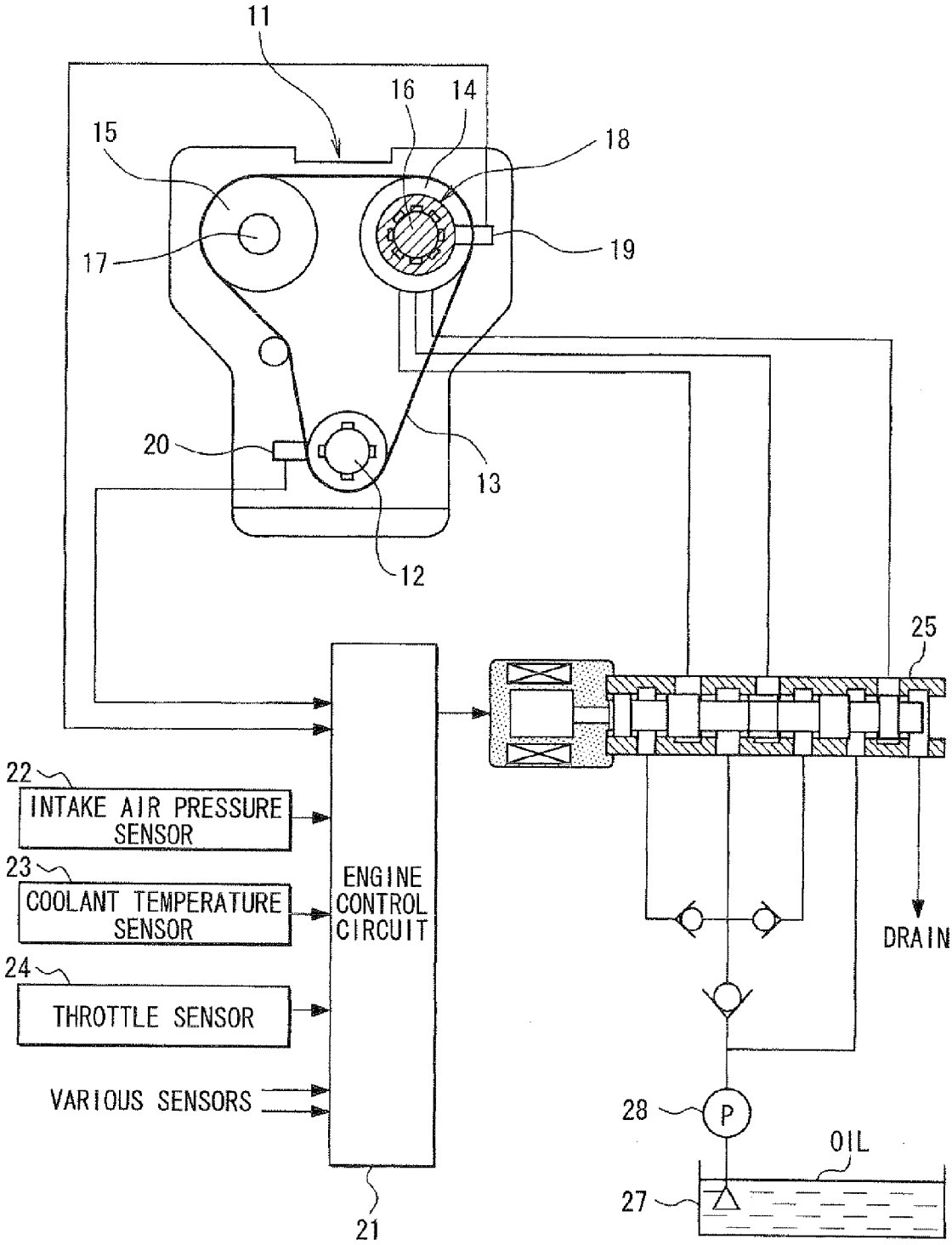
FIG. 1 is a schematic configuration generally illustrating a control system according to one embodiment of the present invention.

As shown in FIG. 1, an engine 11 (internal combustion engine) transmits drive force from a crankshaft 12 to an intake camshaft 16 and an exhaust camshaft 17 through a timing chain 13 and sprockets 14, 15. The intake camshaft 16 is provided with a variable valve timing device 18 (VCT) that adjusts an advance amount (or a VCT phase) of the intake camshaft 16 relative to the crankshaft 12. More specifically, the VCT phase is a rotational angular position of the intake camshaft 16 relative to a rotational angular position of the crankshaft 12.

Also, a cam angle sensor 19 (rotation angle sensor) is provided at a position radially outward of the intake camshaft 16 for outputting cam angle signal pulses at predetermined cam angles in order to identify cylinders. Also, a crank angle sensor 20 (rotation angle sensor) is provided at a position radially outward of the crankshaft 12 for outputting crank angle signal pulses at predetermined crank angles. The signals outputted from the cam angle sensor 19 and the crank angle sensor 20 are fed to an engine control circuit 21. The engine control circuit 21 computes actual valve timing (actual VCT phase) of the intake valve and computes an engine rotation speed based on a frequency (pulse interval) of the output pulses of the crank angle sensor 20 (rotational speed detector). Also, the other signals outputted by various sensors (an intake air pressure sensor 22, a coolant temperature sensor 23, a throttle sensor 24) for detecting an engine operational state are fed to the engine control circuit 21.

The engine control circuit 21 executes fuel injection control and ignition control based on the engine operational state detected by the various sensors. Also, The engine control circuit 21 executes variable valve timing control (phase feedback control), in which the engine control circuit 21 feedback controls oil pressure that actuates the variable valve timing device 18 such that the actual valve timing of the intake valve (or an actual VCT phase) becomes target valve timing (target VCT phase) determined in accordance with an engine operational state).

Figure 2:
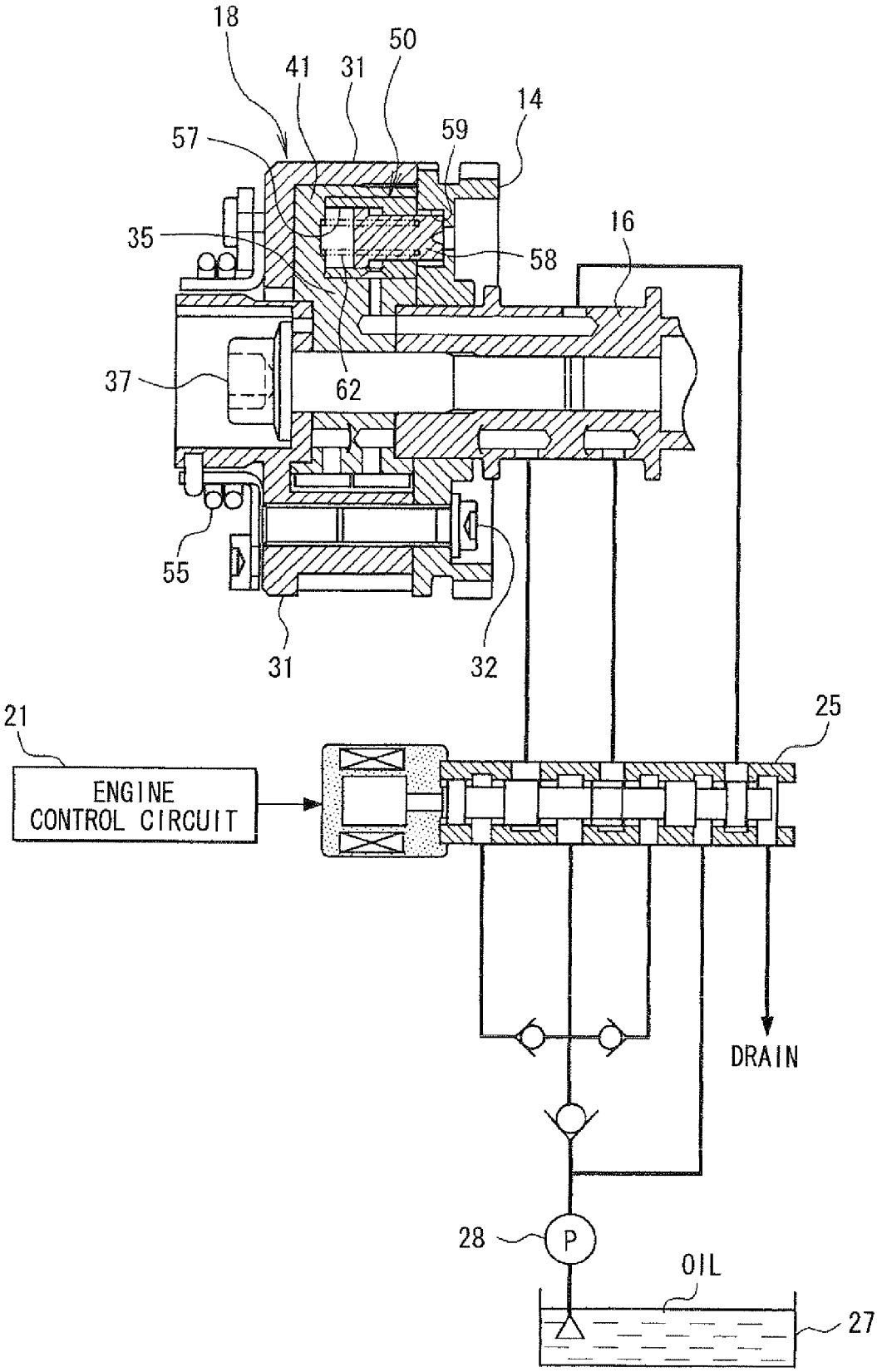
FIG. 2 is a diagram for explaining a variable valve timing device and a hydraulic control circuit (hydraulic control unit) of the one embodiment.

Next, the variable valve timing device 18 will be described with reference to FIGS. 2 and 3.

The variable valve timing device 18 has a housing 31 that is fixed to the sprocket 14 through a bolt 32. The sprocket 14 is movably supported at a position radially outward of the intake camshaft 16. Thus, when the rotation of the crankshaft 12 is transmitted to the sprocket 14 and the housing 31 through the timing chain 13, the sprocket 14 and the housing 31 are rotated synchronously with the crankshaft 12.

The intake camshaft 16 has one end portion that is fixed to a rotor 35 through a bolt 37. The rotor 35 is received within the housing 31 and is rotatable relative to the housing 31.

Figure 3:
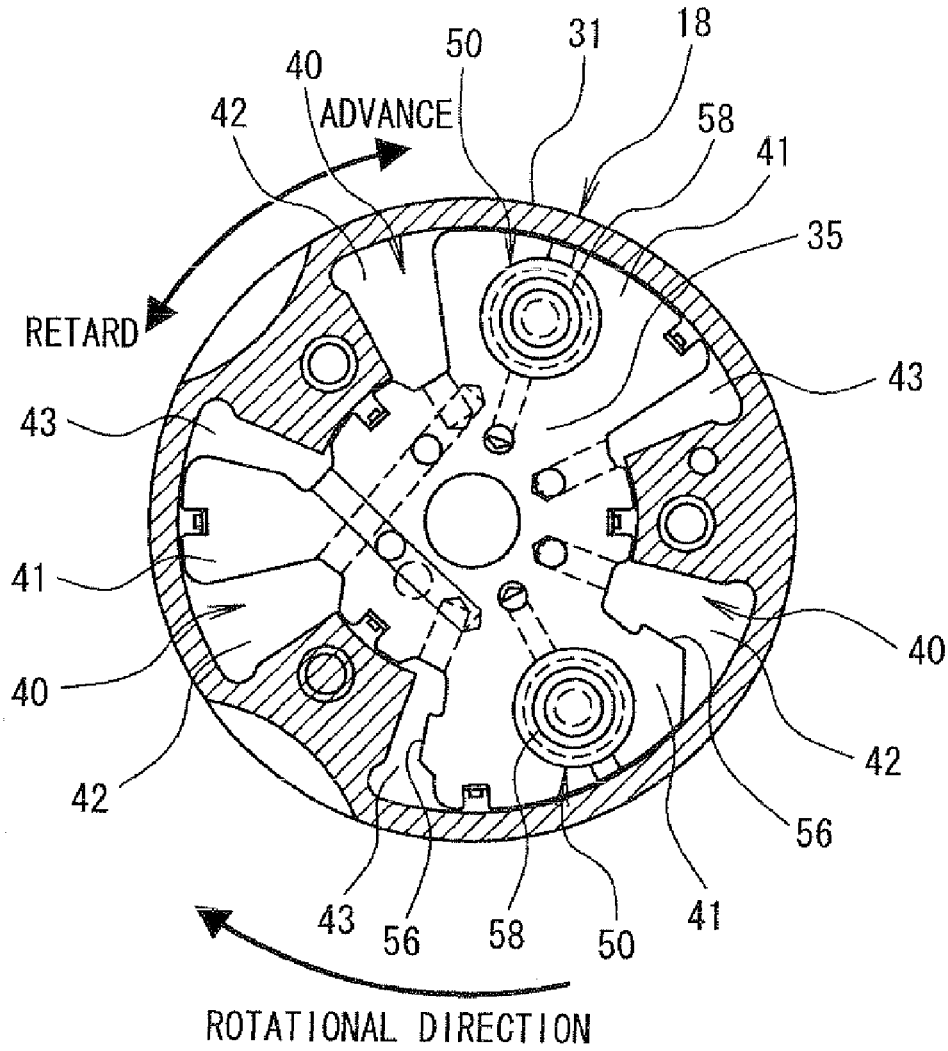
FIG. 3 is a sectional view of the variable valve timing device of the one embodiment taken along a plane perpendicular to a longitudinal axis of the variable valve timing device.

As shown in FIG. 3, multiple vane receiving chambers 40 are formed within the housing 31, and vanes 41 are formed at radially outward parts of the rotor 35. Each of the vane receiving chambers 40 is divided into an advance chamber 42 and a retard chamber 43 by the corresponding vane 41. At least one of the vanes 41 has both circumferential ends that are provided with respective stoppers 56. Each of the stoppers 56 limits a rotational range of the rotor 35 (the vane 41) relative to the housing 31. The stoppers 56 defines a full retard position and a full advance position of an adjustable range of the actual VCT phase (camshaft phase).

The variable valve timing device 18 is provided with an intermediate lock mechanism 50 that is adapted to lock the VCT phase at an intermediate lock position. For example, the intermediate lock position corresponds to a position or a phase between the full advance position and the full retard position (for example, a generally middle position) of the above adjustable range. The intermediate lock mechanism 50 will be described below. A lock pin receiving hole 57 is provided to one of the multiple vanes 41. Alternatively, multiple lock pin receiving holes 57 may be provided to the multiple vanes 41, respectively. The lock pin receiving hole 57 receives therein a lock pin 58 that is displaceable to project from the lock pin receiving hole 57. The lock pin 58 locks the rotation of the rotor 35 (the vane 41) relative to the housing 31 when the lock pin 58 projects from the lock pin receiving hole 57 toward the sprocket 14 to be inserted into a lock hole 59 of the sprocket 14. As a result, the VCT phase is locked at the intermediate lock position located generally in the middle of the adjustable range. The intermediate lock position is set at a phase that is suitable for starting the engine 11. It should be noted that the lock hole 59 may be alternatively provided to the housing 31.

The lock pin 58 is urged by a spring 62 in a lock direction for locking the VCT phase. In other words, the lock pin 58 is urged in a projection direction, in which the lock pin 58 is capable of projecting from the lock pin receiving hole 57. Also, an oil pressure chamber for releasing the lock is formed between (a) the radially outward part of the lock pin 58 and (b) the lock pin receiving hole 57. The oil pressure chamber is used to control oil pressure that actuates the lock pin 58 in a lock release direction for unlock the rotation of the rotor 35 to release the locked VCT phase. For example, when the pressure in the oil pressure chamber becomes high, the pressure urges the lock pin 58 in the lock release direction such that the lock pin 58 is displaced in the lock release direction against the urging force of the spring 62. Also, when the pressure in the oil pressure chamber becomes low, or is released, the pressure does not urge the lock pin 58 substantially. As a result, the lock pin 58 is urged only in the lock direction by the urging force of the spring 62, and thereby the lock pin 58 is displaced in the lock direction. In the present specification, the operation of urging the lock pin 58 in the lock direction indicates the state, where the pressure in the oil pressure chamber becomes low, and thereby the lock pin 58 is allowed to be displaced in the lock direction as described above. It should be noted that the housing 31 is provided with a spring 55 (see FIG. 2) that provides spring force for assisting oil pressure applied to rotate the rotor 35 relatively in an advance direction during an advance control. The spring 55 may be a helical torsion spring and serves as urging means. In the variable valve timing device 18 of the intake valve, torque of the intake camshaft 16 is applied in a direction for shifting the VCT phase in a retard direction. The above means that the spring 55 urges the rotor 35 to shift the VCT phase in the advance direction that is opposite from the direction of torque applied to the intake camshaft 16.

In the present embodiment, it is designed such that the force of the spring 55 is applied to the rotor 35 when the VCT phase stays within a range from the full retard position to a position immediately before the intermediate lock position. For example, the spring 55 is designed to work for a fail-safe operation during restarting the engine 11 after the engine 11 has abnormally stopped, such as an engine stall. More specifically. when the engine is started in a state, where the actual VCT phase is on a retard side of the intermediate lock position while the lock pin 58 is not fitted with the lock pin receiving hole 57, the spring force of the spring 55 assists an advance operation, in which the actual VCT phase is advanced from the retard side toward the intermediate lock position such that the lock pin 58 is fitted into the lock pin receiving hole 57 in order to lock the VCT phase, during the cranking by a starter (not shown).

In contrast, when the engine is started in another state, where the actual VCT phase is on an advance side of the intermediate lock position, torque of the intake camshaft 16 is applied in the retard direction during the cranking. As a result, the torque of the intake camshaft 16 retards the actual VCT phase from the advance side toward the intermediate lock position such that the lock pin 58 is engaged with the lock pin receiving hole 57 for locking the VCT phase.

Figure 4A:
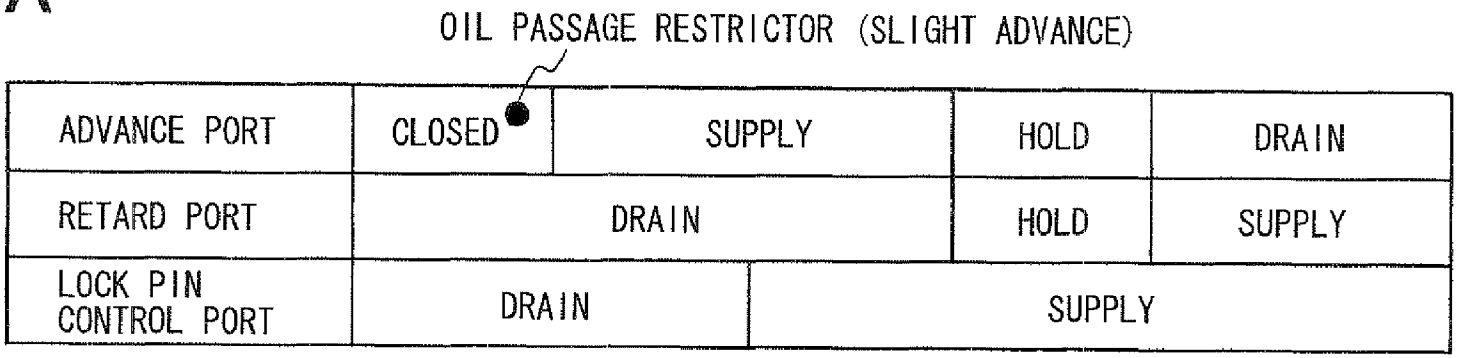
FIG. 4A is a diagram for explaining a switching pattern for switching an operational state of an advance port, a retard port, and a lock pin control port of a hydraulic control valve.
Figure 4B:
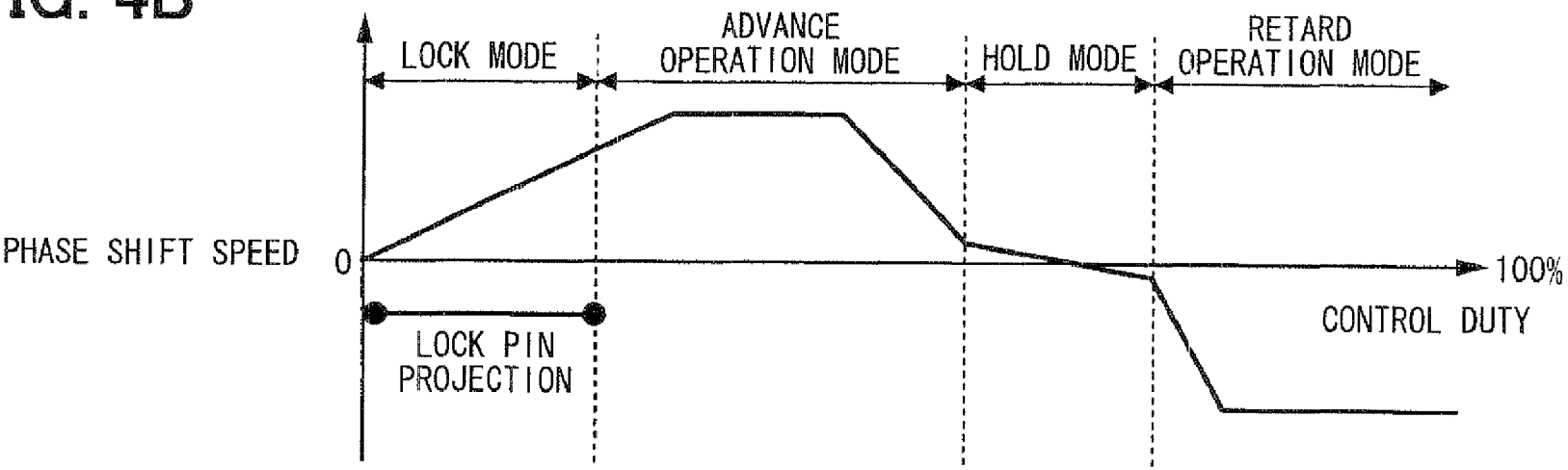
FIG. 4B is a control characteristic diagram of the hydraulic control valve for explaining a relation between (a) a phase change speed and (b) four control ranges of a control duty including a lock mode, an advance operation mode, a hold mode, a retard operation mode.

Also, in the present embodiment, the oil pressure control device controls oil pressure that actuates the VCT phase and the lock pin 58 of the variable valve timing device 18, The oil pressure control device of the present embodiment includes a hydraulic control valve 25 that is structured to function as a phase control hydraulic control valve and as a lock control hydraulic control valve. For example, the phase control hydraulic control valve controls oil pressure that actuates the VCT phase, and the lock control hydraulic control valve controls oil pressure that actuates the lock pin 58. In other words, the hydraulic control valve 25 integrally includes (a) first means for controlling oil pressure that actuates the VCT phase and (b) second means for controlling oil pressure that actuates the lock pin 58. An oil pump 28 is driven by drive force of the engine 11 and pumps oil (hydraulic oil) in an oil pan 27 to supply the oil to the hydraulic control valve 25. The above hydraulic control valve 25 is, for example, an eight-port and four-position spool valve. As shown in FIGS. 4A and 4B, the hydraulic control valve 25 is operated under four operational modes based on a control duty (control amount) of the hydraulic control valve 25. The operational modes have a lock mode (slight advance operation mode), an advance operation mode, a hold mode, and a retard operation mode, for example.

When the operation mode is the lock mode (slight advance operation mode), a lock pin control port of the hydraulic control valve 25 is brought into communication with the drain port such that oil pressure in the lock release oil pressure chamber within the lock pin receiving hole 57 is released, and thereby the spring 62 is allowed to displace the lock pin 58 in the lock direction (projection direction) without the counter force of the oil pressure that otherwise prevents the displacement of the lock pin 58 in the lock direction. Also, a retard port of the hydraulic control valve 25 is brought into communication with the drain port such that oil pressure in the retard chambers 43 are released. In the above communication state, a restrictor in an oil passage connected with an advance port of the hydraulic control valve 25 is slowly changed in accordance with the control duty of the hydraulic control valve 25 such that oil is slowly supplied to the advance chambers 42 through the advance port. As a result, the actual VCT phase is gently shifted in the advance direction.

In the present embodiment, the hydraulic control valve 25 is structured to function as the phase control hydraulic control valve and the lock control hydraulic control valve as above. Thus, in the operation of the lock mode, the VCT phase is gently shifted in the advance direction for the case of the intake valve. For example, the VCT phase is gently shifted in the retard direction for the case of the exhaust valve. Thus, during the operation under the lock mode (lock control), the intermediate lock position is located on the VCT phase shift direction side of the current VCT phase, the VCT phase is gradually shifted to reach the intermediate lock position. As a result, it is possible to fit the lock pin 58 into the lock hole 59.

When the operation mode is the advance operation mode, the retard port of the hydraulic control valve 25 is brought into communication with the drain port such that oil pressure in the retard chamber 43 is released. In the above operation state, oil pressure supplied to the advance chambers 42 through the advance port of the hydraulic control valve 25 is changed in accordance with the control duty of the hydraulic control valve 25. As a result, the actual VCT phase is shifted in the advance direction.

When the operation mode is the hold mode, oil pressure in both the advance chamber 42 and the retard chamber 43 are maintained such that the actual VCT phase is prevented from being shifted.

When the operation mode is the retard operation mode, the advance port of the hydraulic control valve 25 is brought into communication with the drain port such that oil pressures in the advance chambers 42 are released. In the above operation state, oil pressure supplied to the retard chambers 43 through the retard port of the hydraulic control valve 25 is changed in accordance with the control duty of the hydraulic control valve 25 such that the actual VCT phase is shifted in the retard direction.

When the operation mode is the control mode other than the lock mode (such as the retard operation mode, the hold mode, the advance operation mode), the lock release oil pressure chamber within the lock pin receiving hole 57 is filled with oil in order to increase oil pressure in the lock release oil pressure chamber. As a result, the increased pressure of oil pulls the lock pin 58 out of the lock hole 59 such that the lock of the lock pin 58 is released. In other words, the increased oil pressure disengages the lock pin 58 from the lock hole 59 such that the lock of the VCT phase by the lock pin 58 is released.

It should be noted that in the present embodiment, the control mode is changed in the order from the lock mode (slight advance operation mode), the advance operation mode, the hold mode, to the retard operation mode in accordance of the increase of the control duty of the hydraulic control valve 25. However, for example, the control mode may be alternatively changed in the order of the retard operation mode, the hold mode, the advance operation mode, and the lock mode (slight advance operation mode) in accordance with the increased of the control duty of the hydraulic control valve 25. Further alternatively, the control mode may be changed in the other order of the lock mode (slight advance operation mode), the retard operation mode, the hold mode, and the advance operation mode. Also, in a case, where a control range of the lock mode (slight advance operation mode) is directly adjacent to a control range of the retard operation mode, the operation of the hydraulic control valve 25 in the control range for the lock mode (slight advance operation mode) may be executed as follows. For example, in the lock mode, oil pressure in the lock release oil pressure chamber within the lock pin receiving hole 57 is released, and thereby the spring 62 is allowed to displace the lock pin 58 in the lock direction. Simultaneously, the advance port is brought into communication with the drain port such that oil pressure is the advance chamber 42 is released. In the above operation condition, an operational state of the restrictor of the oil passage connected with the retard port is slowly changed in accordance with the control duty of the hydraulic control valve 25 such that oil is slowly supplied to the retard chambers 43 through the retard port. As a result, the actual VCT phase is gently shifted in the retard direction.

The engine control circuit 21 computes the target VCT phase (target valve timing) based on the engine operational condition during the phase feed-back control (variable valve timing control). Then, the control duty (control amount) of the hydraulic control valve 25 is feed-back controlled through, for example, a PD control such that oil pressure supplied to the advance chamber 42 and the retard chambers 43 of the variable valve timing device 18 is feed-back controlled in order to cause the actual camshaft phase of the intake camshaft 16 (actual valve timing of intake valve) to become the target VCT phase (target valve timing).

The engine control circuit 21 serves as a lock control unit. For example, upon the occurrence of a lock request, the engine control circuit 21 controls the hydraulic control valve 25 to execute a lock control (or a control under the lock mode). where the VCT phase is shifted toward the intermediate lock position and the lock pin 58 is allowed to be displaced to be fitted into the lock hole 59 in the projection direction such that the VCT phase is locked at the intermediate lock position.

When the engine rotation speed is reduced to equal to or less than a second rotational speed Ne2 (for example, 800 rpm) after an engine stop command has been generated, the lock request is generated to perform the lock control. For example, the output pulses outputted from the cam angle sensor 19 and the crank angle sensor 20 are not substantially sharp under the operational state of the engine at a substantially low rotational speed range at the time immediately before stopping the engine rotation and at the time of starting the engine (for example, at the time of cranking). Thereby, it may be difficult to accurately identify the edges of the pulses. As a result, it may be difficult to accurately compute the VCT phase, and thereby it may become impossible to identify whether the VCT phase is locked at the intermediate lock position. Thus, even when the VCT phase is not locked at the intermediate lock position by failure during the stop of the engine, the failure in locking the lock phase may not be detected erroneously in the conventional art. Thus, in a case, where the engine 11 stops in a state, where the VCT phase of the intake valve is located near the full advance position, the engine 11 results in being started under the above state of the VCT phase in the next operation. As a result, abnormal combustion, such as pre-ignition, is likely to occur in the conventional art.

In the present embodiment, when the engine rotation speed becomes equal to or less than a first rotational speed Ne1 that is lower than a target idle rotation speed, it is determined whether the VCT phase is on an advance side of the intermediate lock position. The advance direction in the present embodiment corresponds to a lock-mode VCT phase shift direction, in which the VCT phase is shifted during the lock mode. When it is determined that the VCT phase is on the advance side of the intermediate lock position, the VCT phase is shifted in the retard direction that is opposite from the lock-mode VCT phase shift direction so that the VCT phase is shifted toward the intermediate lock position. In contrast, when it is determined that the VCT phase is not on the advance side, the lock pin 58 is allowed to be displaced in the projection direction to be fitted into the lock hole 59 when the VCT phase is shifted and comes to the intermediate lock position. The first rotational speed Ne1 is set at a rotational speed that is equal to or slightly higher than a lower limit value of a predetermined rotational speed range. For example, when the rotational speed is within the predetermined rotational speed range, it is possible to reliably compute the VCT phase based on the output signals of the cam angle sensor 19 and the crank angle sensor 20. In the present embodiment, the first rotational speed Ne1 is set at 300 rpm, for example.

In short, when the VCT phase is located on the lock-mode VCT phase shift direction side (advance side) of the intermediate lock position during the operation under the lock mode, the VCT phase is not shifted to reach the intermediate lock position. Thus, the VCT phase is shifted in the direction opposite from the lock-mode VCT phase shift direction. As a result, even in a case, where the VCT phase is not locked at the intermediate lock position, it is possible to shift the VCT phase in the direction away from the full advance position, where the pre-ignition is more likely to occur during the starting of the engine. Thus, it is effectively prevent the generation of the abnormal combustion, such as the pre-ignition, during the starting of the engine 11 in the next operation.

Furthermore, in the present embodiment, when the engine rotation speed becomes equal to or less than the second rotational speed Ne2 that is set higher than the first rotational speed Ne1 at time t1, the lock request is generated to execute the lock control. In the above case, during idling or stand-by operation, discharge oil pressure of the oil pump 28 is reduced similar to the case at the start of the engine, and thereby, in general, it becomes difficult to maintain the VCT phase at the intermediate lock position, which is suitable for the stand-by operation. Typically, the second rotational speed Ne2 used for generating the lock request may be set equal to or slightly higher than the target idle rotation speed (for example, 800 rpm). As a result, it is possible to quickly start the lock control when the engine rotation speed is reduced to the idle rotation speed range.

When the engine is started while the VCT phase of the intake valve is located around the full advance position, the abnormal combustion, such as pre-ignition, is more likely to occur accordingly with the rise of temperature of the engine 11 (coolant temperature, oil temperature, intake temperature). When temperature of the engine 11 is lower, the abnormal combustion may not likely to occur even in a case, where the VCT phase is located on the lock-mode VCT phase shift direction side (advance side in the present embodiment) of the intermediate lock position.

Taking the above into consideration, in the present embodiment, if the VCT phase is on the advance side of the intermediate lock position, the VCT phase is actuated in the direction (retard direction in the present embodiment) opposite from the Lock-mode VCT phase shift direction when the following two conditions are satisfied. Condition (1): the engine rotation speed becomes equal to or less than the first rotational speed Ne1, and condition (2): coolant temperature detected by the coolant temperature sensor 23 (temperature detector) is equal to or greater than a predetermined coolant temperature. Also, when the coolant temperature is lower than the predetermined coolant temperature, the lock pin 58 is allowed to be displaced in the projection direction. In general, when the coolant temperature is lower than the predetermined coolant temperature, the abnormal combustion may not likely to occur even if the VCT phase is located on the advance side of the intermediate lock position. Thus, when the coolant temperature is lower than the predetermined coolant temperature, the lock pin 58 is allowed to be displaced in the projection direction even if the VCT phase is located on the advance side of the intermediate lock position. As a result, the lock may be completed depending on the change direction of the VCT phase. For example, if the VCT phase is changed in the direction to reach the intermediate lock position, the VCT phase will be successfully locked at the intermediate lock position because the lock pin 58 is displaced in the projection direction to be fitted into the receiving hole 57 when the VCT phase comes to the intermediate lock position.

Also, in the present embodiment, the VCT phase is shifted to the full retard position in the period before the engine rotation speed during the start of the engine exceeds the first rotational speed Ne1 if the coolant temperature is equal to or greater than the predetermined coolant temperature. Also, the lock pin 58 is allowed to be displaced in the projection direction in the period before the engine rotation speed during the start of the engine exceeds the first rotational speed Ne1 if the coolant temperature is less than the predetermined coolant temperature. In general, it is not known whether the VCT phase is actually locked at the intermediate lock position in the period before the engine rotation speed during the start of the engine becomes greater than the first rotational speed Ne1 because the VCT phase is not reliably computable based on the engine rotation speed that is equal to or less than a predetermined rotational speed. However, if the temperature of the engine 11 (coolant temperature) is substantially low as above, the abnormal combustion hardly occurs regardless of the position of the VCT phase (for example, even when the VCT phase is around the full advance position). Accordingly, when the coolant temperature that relates to temperature of the engine 11 is lower than the predetermined coolant temperature, the lock pin 58 is allowed to be displaced in the projection direction. Thus, if the lock pin 58 has already been at the lock position, the lock pin 58 is maintained at the lock position. Also, even if the lock pin 58 is not at the lock position, it is possible to lock the VCT phase when the lock pin 58 reaches the intermediate lock position. In contrast, in a case, where the VCT phase is on the advance side of the intermediate lock position when the coolant temperature is equal to or greater than the predetermined coolant temperature, the abnormal combustion is more likely to occur during the start of the engine in the next operation. Thus, the VCT phase is shifted toward the full retard position in order to prevent the abnormal combustion during the start of the engine 11.

In the above, oil temperature or intake temperature may be alternatively employed instead of the coolant temperature. In other words, temperature information that correlates temperature of the engine 11 may be alternatively employed instead of the coolant temperature.

Next, control examples of the present embodiment will be described with reference to timing charts shown in FIG. 5 and FIG. 6.

Firstly, control example at the stopping of the engine rotation will be described with reference to FIG. 5. In the example of FIG. 5, the engine stop command is generated at time t0, and thereby fuel injection is stopped (or fuel cut). As a result, the engine rotation speed starts decreasing. Thus, when the engine rotation speed becomes, at time t1, equal to or less than the second rotational speed Ne2 (for example, 800 rpm) that is set higher than the first rotational speed Ne1, the lock request is generated in order to start the lock control. In the lock control, firstly, the control duty of the hydraulic control valve 25 is controlled to fall within the control range of the retard operation mode, and the VCT phase is retarded or is shifted in the retard direction. Subsequently, at some point, the control duty of the hydraulic control valve 25 is gradually reduced as the VCT phase becomes closer to the intermediate lock position. At time t2, when the VCT phase has gone over or has passed by the intermediate lock position by a predetermined amount, the control duty of the hydraulic control valve 25 is changed to fall within the control range of the lock mode such that the VCT phase is slightly advanced or is shifted in the advance direction toward the intermediate lock position (see a solid line in FIG. 5 for a case of lock success).

Subsequently, at time t3, when the engine rotation speed has become equal to or less than the first rotational speed Ne1 (for example, 300 rpm) that is lower than the target idle rotation speed, it is determined whether the VCT phase is on the advance side of the intermediate lock position. As shown by a dashed line in FIG. 5, in a case, where the VCT phase is located on the advance side of the intermediate lock position (case of lock failure), the control duty of the hydraulic control valve 25 is maintained within the control range of the retard operation mode in order to drive the VCT phase toward the full retard position. Thus, even when the VCT phase has not been locked at the intermediate lock position, it is possible to shift the VCT phase in the direction away from the full advance position, and thereby it is possible to prevent the abnormal combustion, such as pre-ignition from being generated at the start of the engine next time. For example, when the VCT phase is near the full advance position, the pre-ignition is more likely to occur during the start of the engine.

Figure 5:
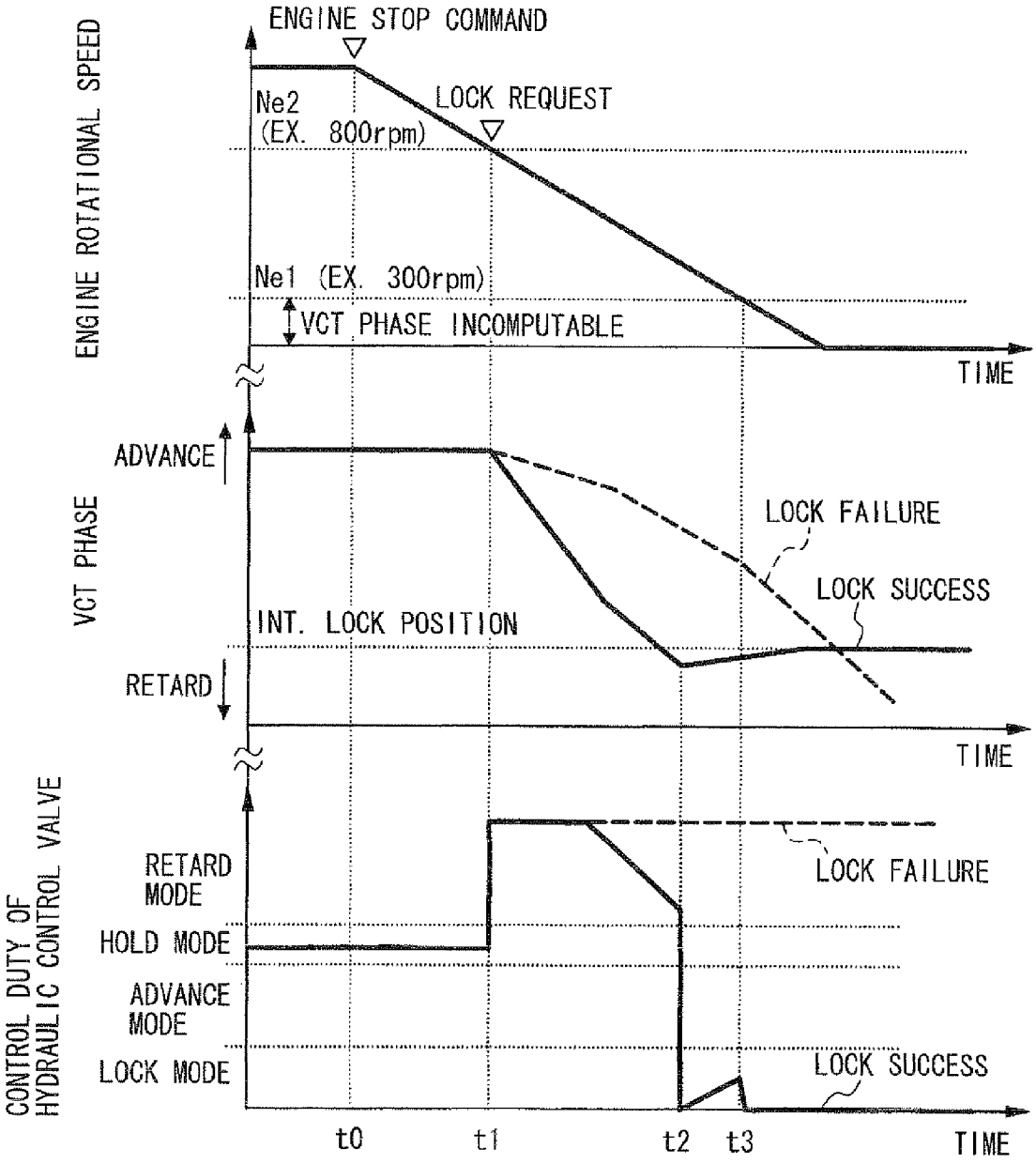
FIG. 5 is a timing chart illustrating a control example for a case of stopping an engine rotation.
Figure 6:
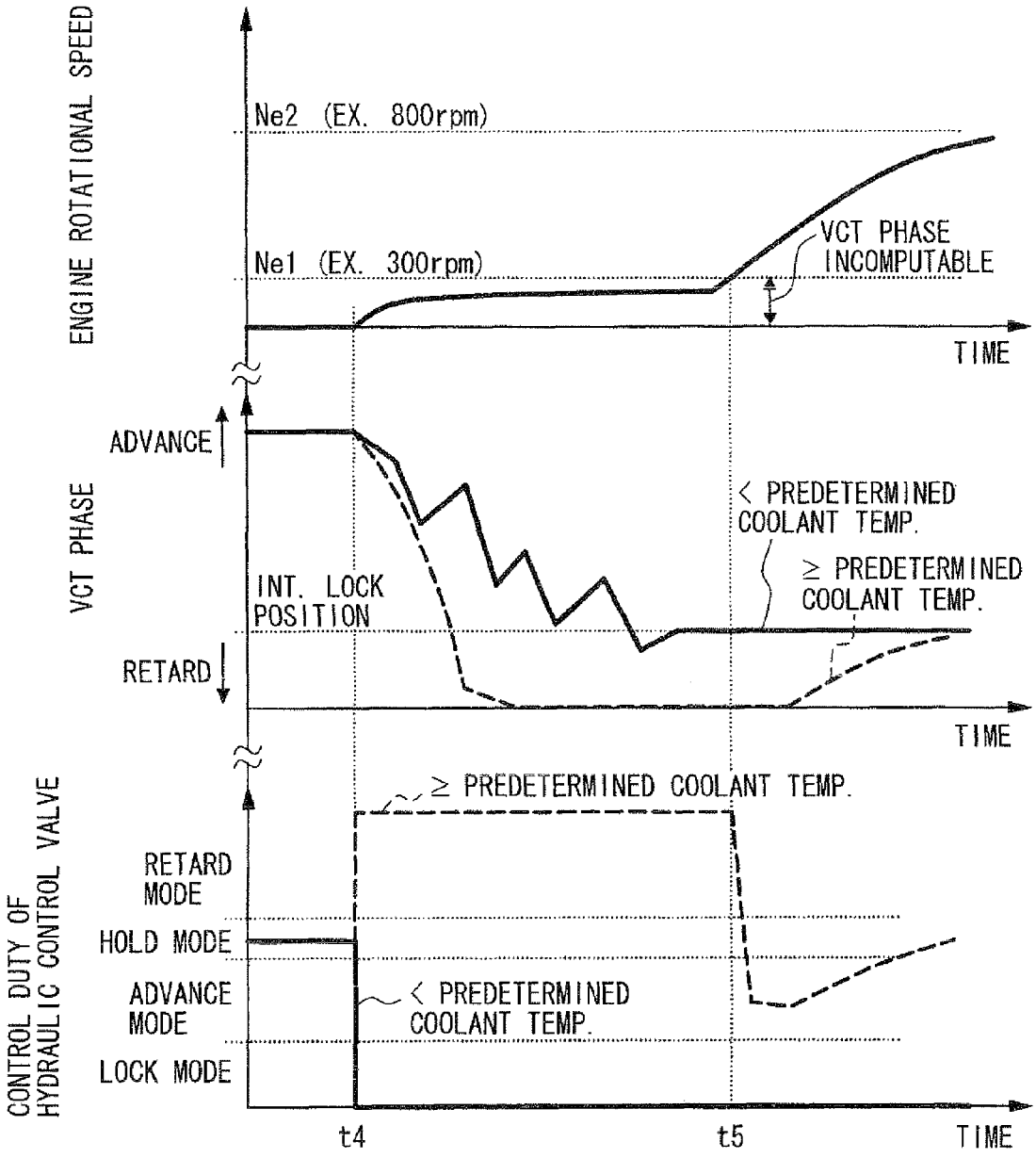
FIG. 6 is a timing chart illustrating a control example for a case of starting an engine.

In contrast, at time t3, when the engine rotation speed has been reduced to equal to or less than the first rotational speed Ne1 that is lower than the target idle rotation speed, as shown by the solid line of FIG. 5, if it is determined that the VCT phase is not located on the advance side of the intermediate lock position, corresponding to lock success, the control duty of the hydraulic control valve 25 is changed to, for example, duty 0% within the control range of the lock mode in order to control the operational mode at the lock state.

Next, a control example at the start of the engine will be described with reference to FIG. 6. In the example of FIG. 6, at time t4, an engine start command (for example, ON signal of an ignition switch) is outputted for causing the starter to start the cranking of the engine 11. Because the engine rotation speed stays within a substantially low rotation range that is equal to or less than the first rotational speed Ne1 during the cranking of the engine 11, it is difficult to identify the edges of the pulses due to the non-sharpness of the output pulses of the cam angle sensor 19 and the crank angle sensor 20. As a result, it is difficult to accurately compute the VCT phase, and thereby it is unknown whether the VCT phase is locked at the intermediate lock position.

During the period before the engine rotation speed exceeds the first rotational speed Ne1, in a case, where the coolant temperature detected by the coolant temperature sensor 23 is equal to or less than the predetermined coolant temperature, it is assumed that the abnormal combustion would hardly occur even when the VCT phase is located at any position (for example, around the full advance position). Thus, the control duty of the hydraulic control valve 25 is changed to the duty 0% of the control range of the lock mode, for example, in order to control the lock pin 58 to be urged in the projection direction. In the above, if the VCT phase has been already locked at the intermediate lock position during the stop of the engine in the previous operation, the VCT phase is maintained locked. In contrast, when the VCT phase was not successfully locked by failure at the stopping of the engine in the previous operation, as shown in a solid line in FIG. 6, the VCT phase will be locked successfully when the VCT phase reaches the intermediate lock position.

In contrast, in a case, where the coolant temperature is equal to or greater than the predetermined coolant temperature, the abnormal combustion is more likely to occur during the start of the engine in the next operation if the VCT phase is located on the full advance position side of the intermediate lock position. Thus, as indicated by a dashed line in FIG. 6, the control duty of the hydraulic control valve 25 is changed to, for example, the duty 100% within the control range of the retard operation mode such that the VCT phase is shifted toward the full retard position. As a result, it is possible to effectively prevent the abnormal combustion from occurring during the start of the engine in the next operation.

At time t5, when the engine rotation speed exceeds the first rotational speed Ne, the control of the VCT phase in accordance with the coolant temperature is ended. Subsequently, until the engine rotation speed exceeds the second rotational speed Ne2, the VCT phase is locked at the intermediate lock position. Specifically, as indicated by the dashed line in FIG. 6, at time t5, when the engine rotation speed exceeds the first rotational speed Ne1, the VCT phase is gently shifted in the advance direction toward the intermediate lock position from the full retard position in order to lock the VCT phase if the VCT phase is controlled to the full retard position. Also, as indicated by the solid line in FIG. 6, at time t5, when the engine rotation speed exceeds the first rotational speed Ne1, if the VCT phase has been already locked, the VCT phase is maintained locked.

Figure 7:
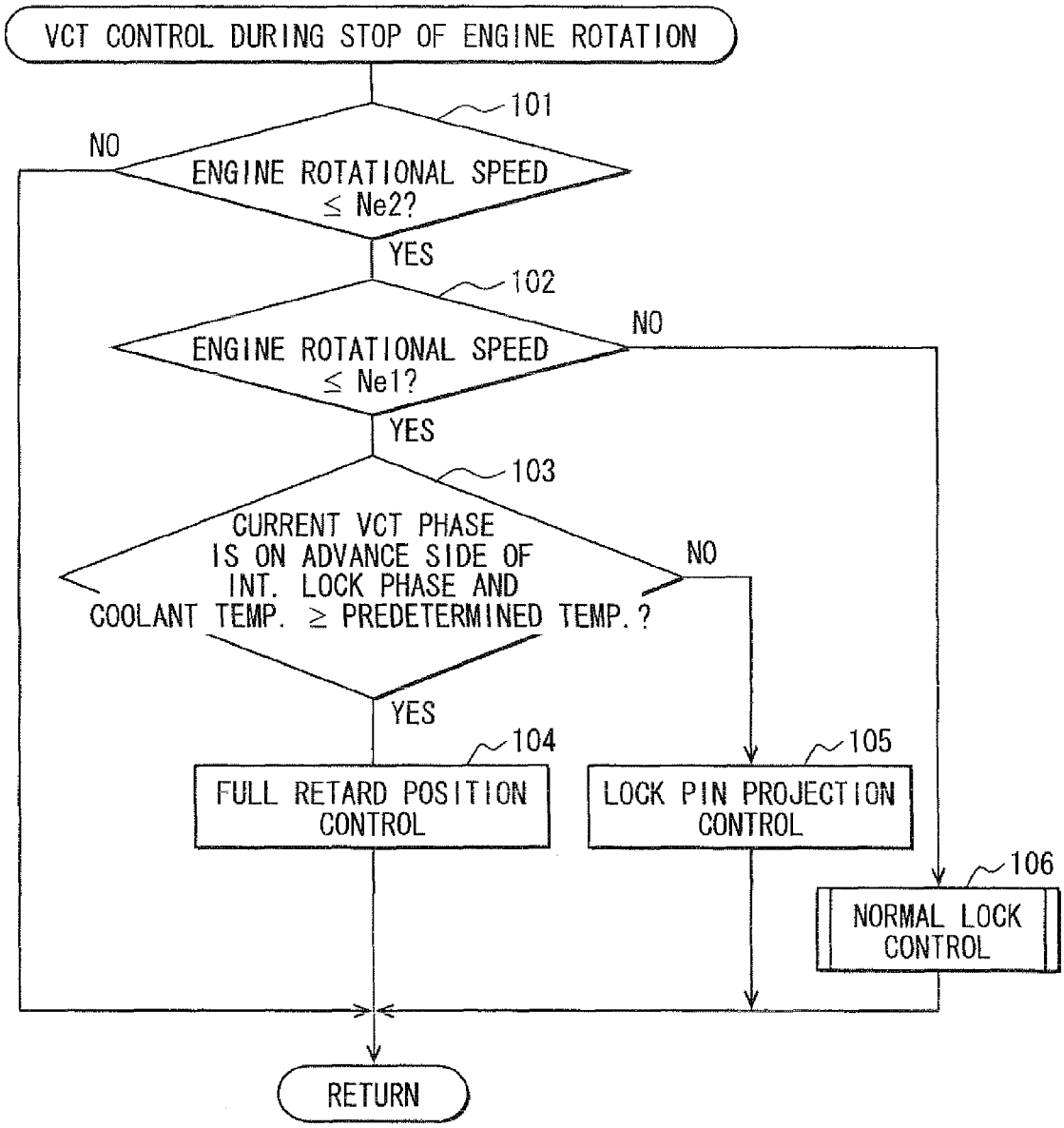
FIG. 7 is a flow chart illustrating a procedure of a VCT control program for the case of stopping the engine rotation.
Figure 8:
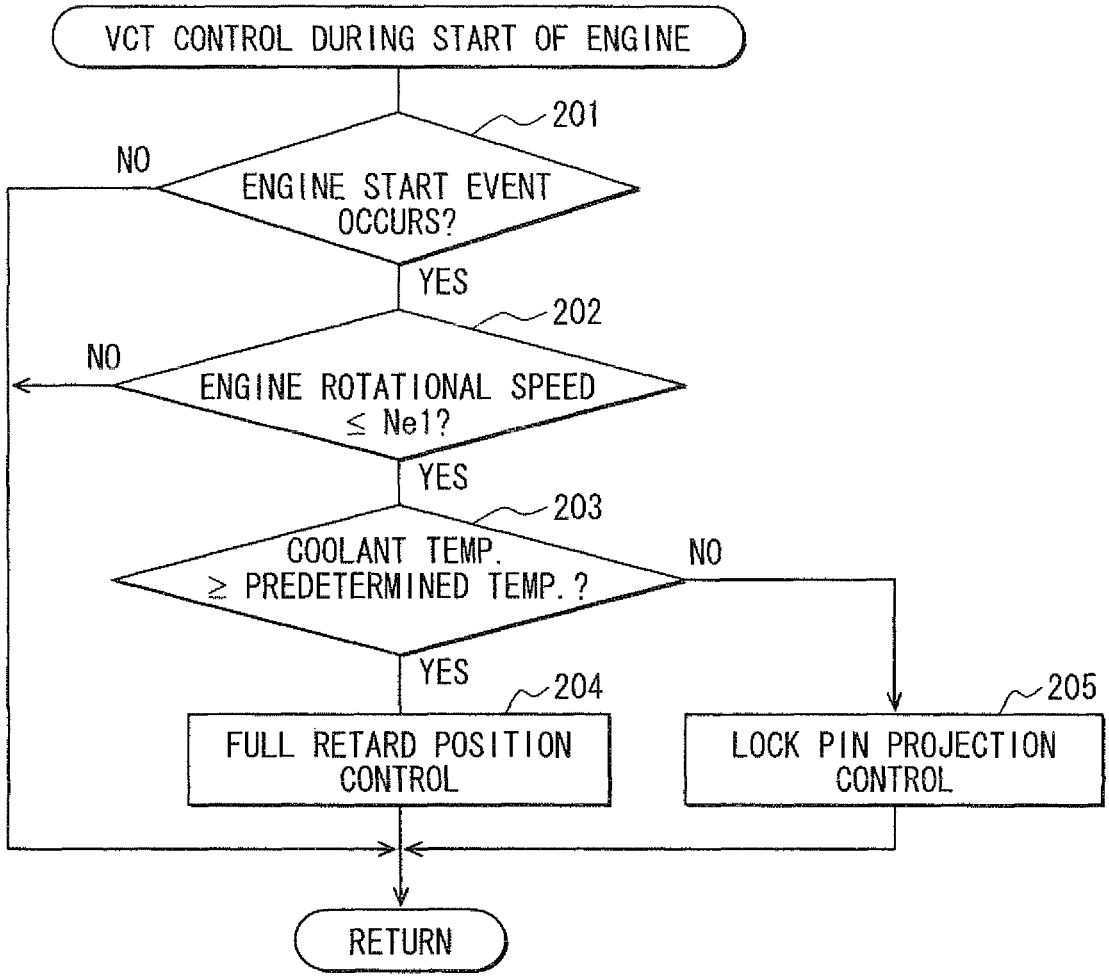
FIG. 8 is a flow chart illustrating a procedure of a VCT control program for the case of starting the engine.

The VCT control of the present embodiment at the stopping of the engine rotation and during the start of the engine rotation is executed by the engine control circuit 21 based on respective program shown in FIG. 7 and FIG. 8. Procedure of each program will be described below.

[VCT Control Program For Case Of Stopping Engine Rotation]

An VCT control program for a case of stopping engine rotation in FIG. 7 is repeated at predetermined intervals during the operation of the engine. The VCT control program serves as a lock control unit. When the present program is started, firstly, it is determined at step 101 whether the engine rotation speed is equal to or less than the second rotational speed Ne2 (for example, 800 rpm). When it is determined that the engine rotation speed has not yet become equal to or less than the second rotational speed Ne2, the present program is ended without executing the subsequent process.

In contrast, when it is determined at step 101 that the engine rotation speed is equal to or less than the second rotational speed Ne2, control proceeds to step 102, where it is determined whether the engine rotation speed is equal to or less than the first rotational speed Ne1 (for example, equal to or less than 300 rpm). When it is determined that the engine rotation speed has not yet become equal to or less than the first rotational speed Ne1 control proceeds to step 106, where a normal lock control is executed.

In contrast, when it is determined at step 102 that the engine rotation speed is equal to or less than the first rotational speed Ne1, control proceeds to step 103, where it is determined whether the following two conditions are satisfied. Condition (1): the current VCT phase (or the VCT phase at a time when the engine rotation speed has just become equal to or less than the first rotational speed Ne1) is on the advance side of the intermediate lock position. Condition (2): the coolant temperature detected by the coolant temperature sensor 23 is equal to or greater than the predetermined coolant temperature. When it is determined at step 103 that both of the above conditions (1) and (2) are satisfied, control proceeds to step 104, where the control duty of the hydraulic control valve 25 is changed to, for example, duty 100% within the control range of the retard operation mode, and thereby the VCT phase is controlled to the full retard position. Thereby, it is possible to prevent the abnormal combustion at the start of the engine in the next operation.

In contrast, when it is determined at step 103 that at least one of the above two conditions (1) and (2) is not satisfied, it is assumed that the abnormal combustion hardly occurs during the start of the engine 11 in the next operation. Thus, control proceeds to step 105, where the control duty of the hydraulic control valve 25 is changed to the duty 0% of the control range of the lock mode, for example, and thereby the lock pin 58 is allowed to be displaced in the projection direction.

[VCT Control Program For Case Of Starting Engine]

A VCT control program for a case of starting the engine in FIG. 7 is repeated at predetermined intervals during the operation of the engine, and serves as the lock control unit. When the present program is started, firstly, it is determined at step 201 whether the engine start event occurs (or whether the engine is being started). When it is determined that the engine start event does not occur, the present program is ended without executing the subsequent process.

In contrast, when it is determined at step 201 that the engine start event occurs, control proceeds to step 202, where it is determined whether the engine rotation speed is equal to or less than the first rotational speed Ne1. When the engine rotation speed has already exceeded the first rotational speed Ne1, the present program is ended without executing the subsequent process.

In contrast, when it is determined at step 202 whether the engine rotation speed is equal to or less than the first rotational speed Ne1 control proceeds to step 203, where it is determined whether the coolant temperature detected by the coolant temperature sensor 23 is equal to or greater than the predetermined coolant temperature. As a result, when it is determined that the coolant temperature is equal to or greater than the predetermined coolant temperature, it is assumed that the abnormal combustion is very likely to occur at the start of the engine 11. Thus, control proceeds to step 204, where the control duty of the hydraulic control valve 25 is changed to, for example, the duty 100% within the control range of the retard operation mode such that the VCT phase is controlled to the full retard position. As a result, it is possible to effectively prevent the abnormal combustion at the start of the engine 11.

In contrast, when it is determined at step 203 that the coolant temperature is equal to or less than the predetermined coolant temperature, it is assumed that the abnormal combustion hardly occurs regardless of the position of the VCT phase (for example, even at the full advance position). Thus, the control duty of the hydraulic control valve 25 is changed to, for example, the duty 0% within the control range of the lock mode such that the lock pin 58 is allowed to be displaced in the projection direction.

In the above present embodiment, at a time, when the engine rotation speed becomes equal to or less than the first rotational speed Ne1 during the stop of the engine rotation, if the current VCT phase is located at a position such that the VCT phase is changed to reach the intermediate lock position during the lock mode, the lock pin 58 is allowed to be displaced in the projection direction. In other words, if the current VCT phase is located on the retard side of the intermediate lock position, the lock pin 58 is allowed to be displaced in the projection direction for locking the VCT phase because the VCT phase is to be shifted in the advance direction during the lock mode of the present embodiment. As a result, the lock pin 58 is eventually caused to be fitted into the lock hole 59 when the VCT phase reaches the intermediate lock position subsequently. In contrast, when the VCT phase is located on the advance side of the intermediate lock position, the VCT phase is not changeable to reach the intermediate lock position, and thereby the VCT phase is shifted in the retard direction that is opposite from the lock-mode VCT phase shift direction (advance direction). As a result, even when it is not possible to lock the VCT phase at the intermediate lock position, the VCT phase is shifted in the direction away from the full advance position, at which the pre-ignition is more likely to occur during the starting of the engine. Thereby, it is possible to effectively prevent the abnormal combustion from occurring during the start of the engine 11 in the next operation.

Furthermore, in the present embodiment, at time, when the engine rotation speed has become equal to or less than the first rotational speed Ne1 during the stop of the engine rotation, if the VCT phase is located on the advance side (lock-mode VCT phase shift direction side) of the intermediate lock position, and also the coolant temperature is equal to or greater than the predetermined coolant temperature, it is assumed that the abnormal combustion is very likely to occur during the start of the engine in the next operation. Thus, the VCT phase is shifted in the direction (retard direction) opposite from the lock-mode VCT phase shift direction. As a result, even when the VCT phase is not locked at the intermediate lock position, it is possible to effectively prevent the abnormal combustion from occurring during the starting of the engine 11 in the next operation. In the above case, when temperature of the engine 11 (coolant temperature) is relatively high, it is possible to assure the startability of the engine 11 even if the VCT phase is not locked at the intermediate lock position.

In contrast, when the coolant temperature is lower than the predetermined coolant temperature, the abnormal combustion, such as pre-ignition, hardly occurs even if the VCT phase is on the advance side (the lock-mode VCT phase shift direction side) of the intermediate lock position. Thus, in the above case, the lock pin 58 is allowed to be displaced in the projection direction, and thereby the lock may be completed depending on the change of the VCT phase. Thus, even in a case, where it is erroneously determined that the VCT phase is on the lock-mode VCT phase shift direction side (the advance side) of the intermediate lock position due to the computation error of the VCT phase, the lock may be completed depending on the change of the VCT phase.

Note that, the present invention is embodied as the intake valve of the variable valve timing device in the present embodiment. However, the present invention may be applicable to a variable valve timing control apparatus of the exhaust valve. In a case, where the present invention is applied to the variable valve timing control apparatus of the exhaust valve, a direction of controlling the VCT phase of the exhaust valve may be alternatively set opposite from the direction of controlling the VCT phase of the intake valve in the above embodiment. In other words, a directional relation between "timing advance" and "timing retard" in the above embodiment may be reversed in the alternative embodiment.

The present invention may be modified in a various manner provided that the modification does not deviate from the gist of the present invention, For example, a configuration of the variable valve timing device 18 and a configuration of the hydraulic control valve 25 may be modified as required.

In the above embodiment, a time period during the stop of the engine corresponds to a time period, in which the rotation of the engine is being reduced in order to deactivate or shut-off the engine.

Additional advantages and modifications will readily occur to those skilled in the art. The invention in its broader terms is therefore not limited to the specific details, representative apparatus, and illustrative examples shown and described.

What is claimed is:

1. A variable valve timing control apparatus for an internal combustion engine having a camshaft and a crankshaft, the variable valve timing control apparatus comprising:

a hydraulic variable valve timing device configured to adjust valve timing by changing a VCT phase that is a rotational phase of the camshaft relative to the crankshaft;

a lock pin configured to lock the VCT phase at an intermediate lock position located between a full retard position and a full advance position within an adjustable range of the VCT phase;

an oil pressure control device configured to control oil pressure that actuates the variable valve timing device and the lock pin;

a lock control unit configured to control the oil pressure control device to execute a lock control, in which the lock pin is displaced in a lock direction to lock the VCT phase at the intermediate lock position when a lock request is generated; and a rotational speed detector configured to detect a rotational speed of the internal combustion engine, wherein:

the oil pressure control device has a hydraulic control valve that integrally includes:

first means for controlling oil pressure that actuates the VCT phase; and second means for controlling oil pressure that actuates the lock pin;

the oil pressure control device is operated under the following operational modes based on a control amount of the oil pressure control device:

a retard operation mode, in which the VCT phase is shifted in a retard direction;

a hold mode, in which the VCT phase is maintained at a certain position;

an advance operation mode, in which the VCT phase is shifted in an advance direction; and a lock mode, in which the lock pin is allowed to be displaced in the lock direction, and in which the VCT phase is slightly shifted in a lock-mode VCT phase shift direction that corresponds to one of the advance direction and the retard direction;

the lock control unit controls the oil pressure control device to shift the VCT phase in a direction opposite from a VCT phase shift direction if the VCT phase is located on the lock-mode VCT phase shift direction side of the intermediate lock position when the rotational speed of the internal combustion engine becomes equal to or less than a first rotational speed that is lower than a target idle rotation speed during a stop of rotation of the internal combustion engine; and the lock control unit controls the oil pressure control device to allow the lock pin to be displaced in the lock direction if the VCT phase is not located on the lock-mode VCT phase shift direction side of the intermediate lock position when the rotational speed of the internal combustion engine becomes equal to or less than the first rotational speed during the stop of the rotation.

2. The variable valve timing control apparatus according to claim 1, wherein:

the lock control unit executes the lock control upon the lock request when the rotational speed of the internal combustion engine becomes equal to or less than a second rotational speed that is greater than the first rotational speed while the rotational speed of the internal combustion engine is reduced.

3. The variable valve timing control apparatus according to claim 1, further comprising:

a temperature detector configured to detect one of coolant temperature, oil temperature, and intake temperature of the internal combustion engine, wherein:

the lock control unit controls the oil pressure control device to shift the VCT phase in the direction opposite from the lock-mode VCT phase shift direction when the rotational speed of the internal combustion engine becomes equal to or less than the first rotational speed during the stop of the rotation of the internal combustion engine if the following two conditions are satisfied:

the VCT phase is located on the lock-mode VCT phase shift direction side of the intermediate lock position; and one of coolant temperature, oil temperature, and intake temperature is equal to or greater than predetermined temperature; and the lock control unit controls the oil pressure control device to allow the lock pin to be displaced in the lock direction when the rotational speed of the internal combustion engine becomes equal to or less than the first rotational speed during the stop of the rotation of the internal combustion engine if at least one of the two conditions is not satisfied.

4. The variable valve timing control apparatus according to claim 1, further comprising:

a rotation angle sensor configured to output a pulse signal synchronously with the rotation of the internal combustion engine, wherein;

the first rotational speed is equal to or slightly higher than a lower limit value of a predetermined rotational speed range; and the VCT phase is computable based on the pulse signal outputted by the rotation angle sensor when the rotational speed of the internal combustion engine indicated by the pulse signal falls within the predetermined rotational speed range.

5. A variable valve timing control apparatus for an internal combustion engine having a crankshaft and a camshaft, the variable valve timing control apparatus comprising:

a hydraulic variable valve timing device configured to adjust valve timing by changing a VCT phase that is a rotational phase of the camshaft relative to the crankshaft;

a lock pin configured to lock the VCT phase at an intermediate lock position located between a full retard position and a full advance position within an adjustable range of the VCT phase;

an oil pressure control device configured to control oil pressure that actuates the variable valve timing device and the lock pin;

a lock control unit configured to control the oil pressure control device to execute a lock control, in which the lock pin is displaced in a lock direction to lock the VCT phase at the intermediate lock position when a lock request is generated;

a rotational speed detector configured to detect a rotational speed of the internal combustion engine; and a temperature detector configured to detect one of coolant temperature, oil temperature, and intake temperature of the internal combustion engine, wherein:

the lock control unit controls the oil pressure control device to shift the VCT phase toward one of the full retard position and the full advance position in a period before the rotational speed of the internal combustion engine exceeds a predetermined rotational speed during a start of the internal combustion engine if the one of the coolant temperature, the oil temperature, and the intake temperature is equal to or greater than a predetermined temperature;

the lock control unit controls the oil pressure control device to allow the lock pin to be displaced in the lock direction in the period before the rotational speed of the internal combustion engine exceeds the predetermined rotational speed during the start of the internal combustion engine if the one of the coolant temperature, the oil temperature, and the intake temperature is less than the predetermined temperature; and the VCT phase is computable when the rotational speed is greater than the predetermined rotational speed.

* * * * *